US010385510B2

(12) United States Patent
Lee

(10) Patent No.: US 10,385,510 B2
(45) Date of Patent: Aug. 20, 2019

(54) SEAMLESS PRESS FELT WITH INTERMEDIATE ELASTIC CARRIER LAYER

(71) Applicant: AstenJohnson, Inc., Charleston, SC (US)

(72) Inventor: Henry Lee, Simpsonville, SC (US)

(73) Assignee: AstenJohnson, Inc., Charleston, SC (US)

( * ) Notice: Subject to any disclaimer, the term of this patent is extended or adjusted under 35 U.S.C. 154(b) by 287 days.

(21) Appl. No.: 15/353,104

(22) Filed: Nov. 16, 2016

(65) Prior Publication Data

US 2018/0135247 A1 May 17, 2018

(51) Int. Cl.
*D21F 7/08* (2006.01)

(52) U.S. Cl.
CPC ..... *D21F 7/08* (2013.01); *D21F 7/083* (2013.01)

(58) Field of Classification Search
CPC ... D21F 7/08; D21F 7/083; D21F 7/10; D21F 7/12
USPC ..... 162/358.1, 358.2, 900
See application file for complete search history.

(56) References Cited

U.S. PATENT DOCUMENTS

| | | | | |
|---|---|---|---|---|
| 2,943,379 | A | 7/1960 | Foltz, Jr. | |
| 3,392,079 | A | 7/1968 | Fekete | |
| 3,815,645 | A | 6/1974 | Codorniu | |
| 3,920,511 | A | 11/1975 | Grieves et al. | |
| 4,781,967 | A | 11/1988 | Legge et al. | |
| 5,268,076 | A | 12/1993 | Best et al. | |
| 5,360,656 | A | 11/1994 | Rexfelt et al. | |
| 5,785,818 | A | 7/1998 | Fekete et al. | |
| 6,514,386 | B2 * | 2/2003 | Watanabe | D21F 7/083 162/358.2 |
| 6,699,366 | B2 | 3/2004 | Paquin et al. | |
| 6,998,023 | B2 | 2/2006 | Crook | |
| 7,105,077 | B2 * | 9/2006 | Onikubo | D21F 3/0227 162/358.2 |
| 7,118,651 | B2 | 10/2006 | Aldrich | |
| 7,207,355 | B2 | 4/2007 | Lee | |
| 7,220,340 | B2 | 5/2007 | Best | |
| 7,892,402 | B2 | 2/2011 | Hawes et al. | |
| 8,372,246 | B2 | 2/2013 | Hawes et al. | |
| 9,315,940 | B2 | 4/2016 | Lee | |

(Continued)

FOREIGN PATENT DOCUMENTS

| | | | |
|---|---|---|---|
| WO | 2012013438 | 2/2012 | |
| WO | WO 2014/172594 | * 10/2014 | D21F 7/10 |

*Primary Examiner* — Eric Hug
(74) *Attorney, Agent, or Firm* — Volpe and Koenig, P.C.

(57) ABSTRACT

A seamless press felt is provided having inner and outer base fabric layers, which can be woven or non-woven, having an MD length and CD width, each including at least a first array of MD oriented yarns and being formed as a continuous unbroken tube structure. An elastic intermediate yarn assembly with parallel and regularly spaced CD yarns, each bonded to an elastic carrier material, is formed as a continuous unbroken tube structure, and is "socked" between the inner and outer base fabric layers. The elastic intermediate yarn assembly has an MD length that is from 1% to 10% less than the MD length of the press felt prior to assembly and is elastically stretched during assembly between the inner and outer base fabric layers. At least one batt layer needled through the inner and outer base fabric layers and the elastic intermediate yarn assembly to fornt he press felt.

21 Claims, 8 Drawing Sheets

(56) References Cited

U.S. PATENT DOCUMENTS

| | | | |
|---|---|---|---|
| 2007/0163667 | A1 | 7/2007 | Crook |
| 2007/0254546 | A1 | 11/2007 | Despault |

* cited by examiner

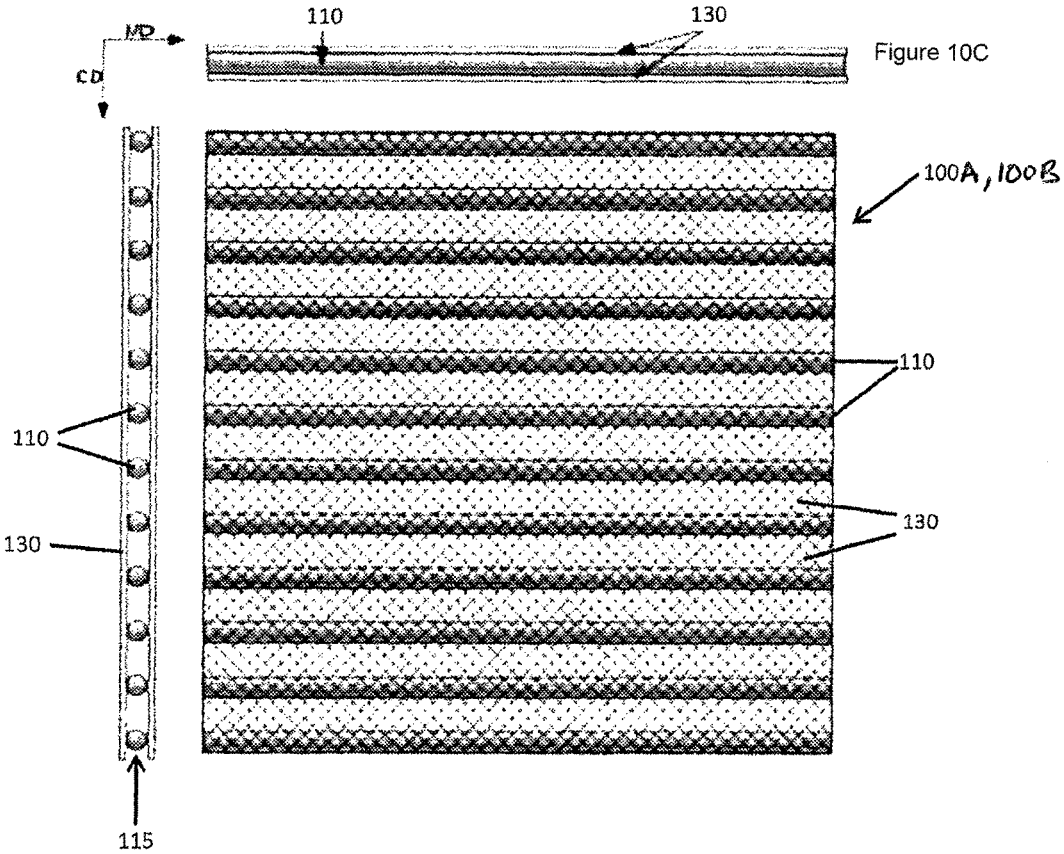
Figure 10B
Figure 10A
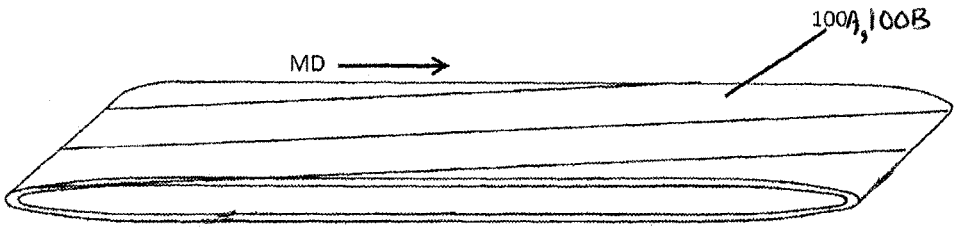
Figure 11

SEAMLESS PRESS FELT WITH INTERMEDIATE ELASTIC CARRIER LAYER

FIELD OF THE INVENTION

The invention generally concerns press felts for use in the manufacture of paper and similar products in a papermaking or like machine. It is particularly concerned with multi-layer press felts which include a nonwoven yarn array bonded to an elastic carrier. This reduces batt shedding and sheet marking while maintaining high void volume, particularly with spirally wound press felts.

BACKGROUND OF THE INVENTION

The present invention concerns press felts for use in the press section of papermaking machines. In the manufacture of paper products, a stock slurry consisting of about 1% papermaking fibers and others solids dispersed in about 99% water is delivered at high speed and precision from a headbox slice onto a rapidly moving forming fabric, or between two forming fabrics, in the forming section of a papermaking machine. The stock is subjected to agitation and is dewatered by various means through the forming fabrics, leaving behind a loosely cohesive and wet web of fibers. This web is then transferred to the press section where a further portion of water is removed by mechanical means as the web, supported by one or more press felts, passes through at least one, and usually a series, of press nips where water is essentially squeezed from the nascent sheet and into the press felt. The water is accepted by the press felt and, ideally, does not return to the web. The resulting sheet is then passed to the dryer section which includes a series of rotatable dryer drums, or cans, that are heated by steam. The sheet is directed around and held in contact with the periphery of these drums by one or more dryer fabrics so that the majority of the remaining water is removed by evaporation.

Press felts play a critical role in the manufacture of paper products. The known press felts are produced in a wide variety of styles designed to meet the requirements of the papermaking machines on which they are installed, and the paper grades being manufactured. They are generally assembled using a woven or nonwoven base fabric structure into which is needled one and usually multiple layers of a fibrous nonwoven batt. The batt provides a smooth surface upon which the paper product is conveyed, acts as a reservoir to trap water expressed at the press nip, and provides a measure of resiliency to the press felt as it passes through the nip. The base fabrics are typically woven from monofilament, cabled monofilament, multifilament or similar multicomponent yarns; they may also be arranged as nonwoven planar arrays. The component yarns are usually comprised of an extruded polymeric resin, typically a polyamide.

The base fabrics may be of single layer or multilayer construction, or they may be formed from two or more layers which are laminated together. They may be woven endless, so that the resulting fabric resembles a tube with no seam; such fabrics must be prepared to the length and width of the machine for which they are intended, and must be slipped onto the press section in a manner similar to a sock. An example of such a fabric is provided in U.S. Pat. No. 7,118,651. In a modified endless weaving technique, the weft yarns are used to form seaming loops at the widthwise fabric edges during manufacture; when installed on the papermaking machine, these yarns will be oriented in the intended machine direction (MD) allowing the fabric to be joined by bringing the loops from each side together and inserting a pin, or pintle, through the resulting channel formed by the intermeshed loops. An example of a modified endless woven fabric may be found in U.S. Pat. No. 3,815,645. The base fabrics may also be flat woven, using one or more layers of warp or weft yarns; a seam is typically formed at each end allowing the fabric to be joined on the machine. An example of a flat woven base fabric may be found in U.S. Pat. No. 7,892,402. All of the above constructions require that the base fabric be woven to the full width and length of the machine for which they are intended; this is a time-consuming process and requires high capital investment in wide industrial looms. In an effort to reduce manufacturing time and costs, so-called "multiaxial fabrics" have recently been introduced for the production of press felts.

Multiaxial press felts are well known and are described in U.S. Pat. Nos. 5,360,656; 5,268,076; 5,785,818 and others. The base fabrics of these press felts are comprised of a plurality of spirally wound and edgewise joined turns of a material strip including at least machine direction (MD) oriented yarns. The material strip is usually a flat woven fabric which is narrower than the width of the intended base fabric of which it is a component; it has also been proposed to use nonwoven arrays of MD yarns as the material strip component. Regardless of whether the component is woven or nonwoven, during assembly each turn of the material strip is directed about two opposing rollers such that its component MD yarns are canted at a small angle that is from about 1° to about 8° to the intended MD of the finished fabric; see prior art FIG. 1. Each successive turn of the material strip is edgewise bonded to that laid adjacent to it so as to build up a continuous tube-like base fabric of desired width and length. When removed from the assembly rollers, a continuous tube is provided that can be flattened into continuous top and bottom surfaces joined at cross-machine direction (CD) oriented fold regions at each of the two opposing ends which can be used to form a seam; see prior art FIG. 2, or can be used as an endless base fabric. The completed multiaxial base fabrics are typically one of a two, three or four layer construction comprising the top and bottom surfaces of the spirally wound continuous tube. The assembled base fabrics may be provided with a seam to facilitate their installation on the machine for which they are intended, for example as shown in FIG. 4.

Regardless of its construction, the primary function of the press felt is to act as a reservoir to transport water expressed from the paper sheet as it passes through a press nip in the press section of the papermaking machine. The base fabric must therefore provide a measure of void volume, or empty interior space, into which the water can pass, and be held, until it can be removed at a later process stage. This space can be provided either by the weave structure of the base fabric in the manner described in U.S. Pat. No. 7,207,355 and as shown in cross-section in prior art FIG. 5, or the base fabric may include at least one additional fabric structure, such as a woven or nonwoven fabric, as mentioned above. Other constructions are possible.

Several issues with such press fabrics are known, some of which are described in the inventor's prior U.S. Pat. No. 9,315,940, which is directed to a seamed press felt. During seam installation, at least a portion of the batt (and occasionally a portion of the component yarns of the woven or nonwoven base fabric) is cut to open the seam loop region and allow for removal of unwanted material adjacent the MD yarn loops. A "flap" of batt material is thus formed which must be securely reattached to the fabric so as to cover the seam region when the fabric is in use. This flap of material creates various problems in the finished press felt. As the batt flap begins to wear during use, some of the base fabric yarns at the cut edge may become loose and begin to pull out of the woven structure and batt, a phenomenon commonly known in the art as "stringing". These exposed yarns will mark the sheet and promote more rapid degradation of the press felt at the seam region. In addition, because the base fabric is load bearing, this load may cause the base to retract back from the seam area, producing an open seam gap, which is also undesirable as it causes marking on the sheet.

In seamed press felts, efforts have been made to ensure secure batt anchorage where it is normally cut during seam installation and minimize discontinuities in the seam region. Stuffer yarns are known for use in seam areas to address this issue. However, the seam still creates a discontinuity in the fabric that can mark the sheet being carried through the press section. In multiaxial base fabrics, stuffer yarns cannot be inserted during weaving and must instead be manually installed after the full width base fabric is assembled. The present inventor had previously addressed this in connection with seamed multiaxial base fabrics through the insertion of an elastic carrier layer that included high surface area yarns that are anchored adjacent to the seam loops in U.S. Pat. No. 9,315,940.

DISCUSSION OF THE PRIOR ART

The majority of base fabric constructions presently used in the known press felts are each woven, which makes them complex and time consuming to produce, and introduces various difficulties as have been described above in detail. Various nonwoven constructions have been proposed in an effort to eliminate the need to weave these fabrics. For example, U.S. Pat. No. 2,943,379 discloses a press felt base fabric including a single array of longitudinally oriented yarns interlocked by needling batt to one or both sides. U.S. Pat. No. 3,392,079 discloses a press felt comprising a nonwoven array of yarns each having a fuzzy character and a batt that is oriented at right angles with respect to these yarns. U.S. Pat. No. 3,920,511 teaches a base fabric formed from a plurality of lapped layers of longitudinally oriented fibers consolidated by needling. U.S. Pat. No. 4,781,967 discloses a nonwoven press felt composed of modular layers, each of which is comprised of a parallel array of yarns supported by at least one layer of batt material, and each of which is oriented so as to be nonparallel to the next.

U.S. Pat. No. 6,699,366 discloses a press felt base fabric comprised of a nonwoven net-like structure mesh which is either spirally wound in non-overlapping turns so as to build up an integral structure, or which uses individual strips of nonwoven mesh laid in side-by-side abutting relation to form a plurality of endless loops of equivalent length.

U.S. Pat. No. 6,998,023 discloses a press felt consisting of a base fabric (carrier layer) and at least 2 nonwoven layers comprised of "ultra-coarse" non-continuous fibers on the paper surface which are oriented at small but opposite angles to the MD to provide a bi-axial construction with a cross orientation.

US 2007/0254546 discloses a nonwoven textile assembly formed from a uniform array of parallel yarns to which an adhesive is applied, and a second component such as another yarn array, a nonwoven mesh or scrim.

US 2007/0163667 describes a seamed press felt which includes an inner sleeve, which can be a woven or nonwoven base structure, and an outer sleeve of spirally wound MD yarn which is wound continuously around the inner sleeve. Batt material is needled into the inner sleeve so that it is located between the inner and outer sleeve. The inner sleeve can be one of an open mesh scrim, an extruded mesh, a thin single layer woven fabric, joined spun bonded yarns, films and the like but should be a material having some measure of CD strength and stability with minimal MD yarns.

WO 2012/013438 proposes a press felt including a first fiber layer which is a stitch bonded material and at least one further layer such as a woven base, a bonded yarn array or batt material, in which the first fiber layer is bonded to the at least one further layer.

U.S. Pat. No. 7,220,340 discloses a nonwoven dryer or press fabric comprising a layer of MD yarns overlaid with a layer of CD yarns in which the yarns are connected positively to one another at crossing points by means of an adhesive, snap-fit (peg and hole) or by localized melting at the crossing points.

U.S. Pat. No. 8,372,246 (the '246 patent) discloses the insertion of a layer of a nonwoven material into the interior area between the upper and lower layers of a spirally wound press felt base fabric, specifically to reduce the appearance of interference patterns (and their attendant problems of batt shedding, uneven dewatering, surface non-uniformities, and others) between these two layers. The nonwoven layer is said to consist of materials such as a knitted fabric, an extruded mesh, MD or CD yarn arrays, and full width or spirally wound strips of nonwoven fibrous material. The nonwoven layer is said to comprise a sheet or web structure bonded together by entangling fiber or filaments mechanically, thermally or chemically and may be made of any suitable material such as polyamide or polyester resins and then located between the upper and lower woven layers by any means known to those skilled in the art. However, this disclosure does not address any of the above deficiencies relating to the seam region of the resulting multiaxial press felt, nor does it disclose any specifics as to methods of adjusting interior void volume, providing vibration resistance, or improving the overall uniformity of the finished press felt. In particular, the '246 patent does not address means of adjusting physical properties of the nonwoven layer so as to improve seam uniformity.

It would be desirable to provide a press felt base fabric construction which addresses the known problems of sheet marking, batt shedding, fabric compaction and void volume loss in the known press felt constructions, and particularly multiaxial press felt constructions.

SUMMARY OF THE INVENTION

In one aspect, a seamless press felt is provided comprising an outer base fabric layer, which can be woven or non-woven, having an MD length and CD width including at least a first array of MD oriented yarns and is formed as a continuous unbroken tube-like structure. An inner base fabric layer, which can be woven or non-woven, having the MD length and the CD width and including at least a second array of MD oriented yarns and formed as a continuous unbroken tube-like structure is located within the outer base fabric layer. A elastic intermediate yarn assembly including a CD array of mutually parallel and regularly spaced polymeric yarns, each bonded to an elastic carrier material that is extensible by at least 1% of a relaxed length thereof that is in the form of a continuous unbroken tube-like structure is provided, with the elastic intermediate yarn assembly being located between the inner and outer base fabric layers. The elastic intermediate yarn assembly has an MD length that is from 1% to 10% less than the MD length prior to assembly and is elastically stretched during assembly between the inner and outer base fabric layers. At least one batt layer is needled through the inner and outer base fabric layers and the elastic intermediate yarn assembly to join the layers together.

The elastic carrier material is preferably an elastic, stretchable sheet-like material such as a nonwoven scrim, a stretchable membrane, film or woven elasticized yarns. The elastic intermediate yarn assembly is preferably stretchable from 1% to 15%

In a preferred aspect of the invention, the elastic intermediate yarn assembly is formed from a plurality of yarn panels and a connector yarn panel. The yarn panels have a bonded connection to edges of adjacent ones of the yarn panels. In order to form the continuous unbroken tube-like structure, a first edge of the connector yarn panel is bonded to an exposed edge of a first one of the yarn panels and a second edge of the connector yarn panel is bonded to an exposed edge of a last one of the yarn panels. The MD length of the elastic intermediate yarn assembly is adjusted by selecting a required number of yarn panels and forming the connector yarn panel of a desired length so that the MD length of the elastic intermediate yarn assembly is from 1% to 10% less than the outer base fabric layer MD length.

The elastic intermediate yarn assembly is uniformly stretched so as to remove any creases or other planar deformations during assembly. Preferably, the elastic carrier material is stretched at least 1%, and more preferably from 2% to 10%.

In another aspect, the press felt is a nonwoven multiaxial press felt. The inner and outer base fabric layers each comprise a plurality of spirally wound turns of a first fabric structure, the first fabric structure including a planar yarn array of the MD oriented yarns comprising single polymeric monofilaments arranged at a first density, at least two layers of a hot melt adhesive web having a first melting temperature, one of the layers of the hot melt adhesive located on each side of the first planar yarn array, and a layer of an elastic carrier material located over each of the layers of the hot melt adhesive web, which is preferably a fine fibrous scrim. The planar yarn array, the two layers of the hot melt adhesive web, and the layers of the fine fibrous scrim material located over the two layers of the hot melt adhesive web are heated above the first temperature to form the respective inner and outer base fabric layers. The yarns of the planar yarn array become the first array of MD yarns for the outer fabric layer and the second array of MD yarns for the inner fabric layer. Each adjacent one of the wound turns is oriented at an angle to the MD and is bonded to an adjacent turn to provide a continuous tube.

Preferably, the respective inner and outer base fabric layers of the press felt, whether woven or non-woven, each include at least two yarn arrays that are oriented generally orthogonal to each other, within about 5° of true perpendicular, based on the angle of the spirally wound MD array.

In one preferred arrangement, the polymers comprising the yarns of the inner and outer base fabric layers, whether woven or non-woven, include the first and second arrays of MD yarns and the array of CD yarns which are monofilaments made of polyamides. More preferably, the yarns of the first and second MD arrays are comprised of polyamide-6 (PA-6) while the CD yarns of the CD array are comprised of polyamide-6/10 (PA-6/10). In another preferred arrangement, the MD yarns are monofilaments, and the CD yarns are cabled monofilaments.

In one preferred arrangement, the MD yarns of the first and second MD arrays are single circular cross-sectional shaped monofilaments having a diameter of from about 0.3 mm to 0.6 mm and are preferably arranged to provide a yarn density of from 15 to 40 yarns/inch (5.9 to 15.7 yarns/cm). More preferably, the diameter of the yarns in the first array is about 0.5 mm.

In one preferred arrangement, the yarns of the CD array are polyurethane filaments, which can be 100% polyurethane, or a polyurethane sheath located over a polyamide, preferably nylon, core. These polyurethane filaments preferably have a diameter of 0.2 mm to 1.0 mm.

The yarns of the CD array can be single circular cross-sectional shaped monofilaments having a diameter ranging from about 0.3 mm to 0.6 mm and are preferably arranged to provide a yarn density of from 15 to 40 yarns/inch (5.9 to 15.7 yarns/cm). More preferably, the diameter of the yarns of the generally planar yarn assembly is less than the diameter of the yarns in the first array and are arranged to provide a yarn density that is greater than the yarn density of the first array. Preferably the diameter of the yarns of the generally planar fabric structure is about 0.4 mm.

The yarns of the elastic intermediate yarn assembly can also be cabled monofilaments having a diameter, d, in the range of 0.1 to 0.3 mm, and may be cabled in one of a d×2×2, d×2×3 or d×3×3 arrangements.

Preferably, the diameter of the yarns in the first and second MD arrays are greater than that of the yarns in the CD array. Alternatively, the diameter of the yarns in the first and second MD arrays and the CD array are the same.

Preferably, the density of the yarns in the first and second MD yarn arrays is less than the density of the yarns in the CD array. Alternatively, the density of the yarns in the first array and generally planar yarn assembly is the same.

Preferably, the melting temperature of the hot melt adhesive web is less than the melting temperature of the elastic carrier material.

Preferably, the elastic carrier material is a fibrous scrim material that is a thermally bonded nonwoven open network of continuous polymeric fibers having a dtex (mass in grams per 10,000 meters of fiber) in the range of 1 to 10, and an air permeability of from about 100 cfm (~1560 $m^3/m^2/hr$) to 2000 cfm (~31,000 $m^3/m^2/hr$) or more. Preferably, the scrim fibers are comprised of polyamide. Preferably, the polyamide is polyamide-6/6 (PA-6/6).

Preferably, the scrim material has a tensile strength of at least 5 lb/in, and more preferably is in the range of 5 to 10 lb/in.

A preferred assembly method provides that the elastic intermediate yarn assembly is "socked" between the inner and outer base fabric layers. As the MD length of the elastic intermediate yarn assembly is preferably at least 1% less than an overall length of the inner and outer base fabric layers, the elastic intermediate yarn assembly is stretched across its CD width so as to stretch the elastic carrier (with the laminated yarns attached to it) by an amount sufficient to allow the nested tubes formed by the outer base fabric layer, the elastic intermediate yarn assembly, and the inner base fabric layer to lay flat against one another where they are joined by needling on one or more batt layers. The stretching of the elastic intermediate yarn assembly increases the distance between adjacent yarns in the assembly, thus increasing the void volume of the resulting structure by a small amount.

BRIEF DESCRIPTION OF THE DRAWINGS

The foregoing Summary and the following detailed description and claims will be best understood when read in conjunction with the drawings which show the presently preferred embodiments of the invention. In the drawings:

FIG. 10A is a planar view of the first fabric structure provided in FIG. 7 showing the first (MD) yarn array oriented horizontally across the page including a layer of second scrim material laid over the first yarn array; FIG. 10B is a cross-section through the MD yarns of this structure located at the left; and FIG. 10C is a cross-section along an MD yarn provided at the top of FIG. 8A.

FIG. 11 provides a schematic illustration of one of an inner or outer base layer formed from the first fabric structure presented in FIGS. 7, 9 & 10 following a spiral winding process and prior to assembly with elastic intermediate yarn assembly.

DETAILED DESCRIPTION OF THE PREFERRED EMBODIMENTS

Figure 1:
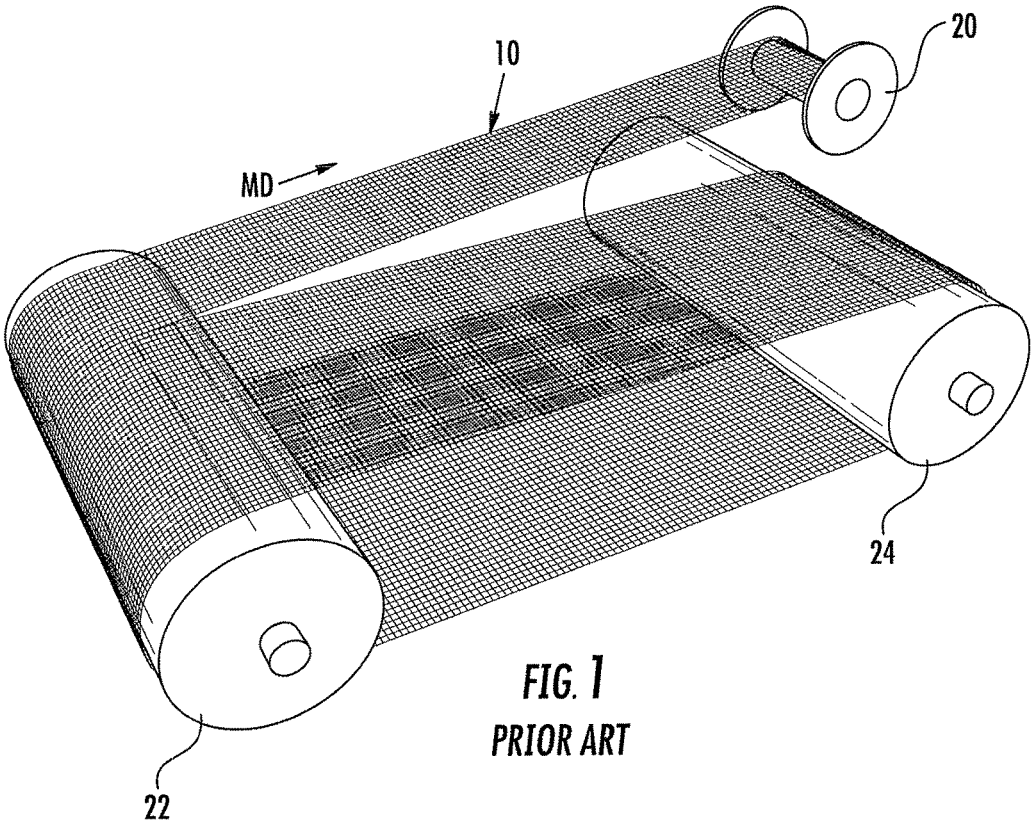
FIG. 1 PRIOR ART
FIG. 1 is an illustration showing a known spiral winding process in which a strip of relatively narrow fabric 10 is spirally wound from a feed source 20 between two opposed rolls 22, 24 to produce a desired width and length of base fabric. Each successive turn of strip 10 is bonded to that to which it is laid adjacent in the process to provide the base fabric.

Certain terminology is used in the following description for convenience only and is not limiting. The words "top," "bottom," "upper" and "lower" designate directions in the drawings to which reference is made. The words "interior" and "exterior" refer to directions within or outside of the two layers of the base fabric. A reference to a list of items that are cited as "at least one of a, b, or c" (where a, b, and c represent the items being listed) means any single one of the items a, b, or c, or combinations thereof. "A" or "an" refer to one or more of the item noted. "MD" refers to a machine direction in the papermaking machine from the headbox to the dryer section and is the longitudinal direction of the press felt. "CD" refers to the cross-machine direction, or a direction perpendicular to the machine direction in the plane of the fabric. The term "PS" refers to the paper side surface of the fabric, which is the surface upon which the paper product is carried through the papermaking machine. "MS" refers to the machine side of the fabric and is the surface opposite to the PS. Unless otherwise specified, the term "yarn" or "yarns" refers to a continuous length of either single or cabled polymeric monofilament such as would be used in the manufacture of the base fabrics of the invention, while the term "fiber" or "fibers" refers to relatively small diameter polymeric materials such as those commonly used in batt or scrim materials which fibers have a very small dtex (mass in grams per 10,000 meters of fiber). The term "array" refers to a generally planar group of mutually parallel yarns which are not interwoven or interconnected with one another by interlacing. The term "fibrous scrim" refers to a bonded cohesive open network of fine fibers made, for example, by spinning and thermally bonding continuous filaments of polyamide into a drapable, conformable textile like material whose component fibers having a dtex that is in the range of from 1 to 10 and an air permeability of from about 100 cfm (~1,560 $m^3/m^2/hr$) to about 2000 cfm (~31,000 $m^3/m^2/hr$) or higher. "Orthogonal" or "perpendicular" as used herein with respect to the CD and MD yarns means generally within about 85° to 95° based on the deviation from true perpendicular created by the spiral winding of the MD yarns in the first yarn array. The terms "left", "right", "up", "down" are used in relation to the drawings and have the meanings usually assigned. Additional definitions for terms used herein are as follows:

Additional Definitions:

"Press felt base fabric": a woven or nonwoven assembly of yarns provided as an endless structure or continuous loop including two superimposed layers joined (when laid flat) at two opposing fold areas including continuous MD yarns passing around the folds. The assemblies can take the form of: a) an endless woven structure, b) a modified endless woven structure, c) a fabric formed according to a multiaxial assembly process, or d) a nonwoven structure assembled to provide any of the previous assemblies. The present invention is applicable to all of the above, but it is particularly suitable for use in both woven and nonwoven multiaxial base fabric constructions. These base fabrics provide the finished press felt with the physical properties (strength, void volume, resiliency) necessary for it to survive the rigors of the machine environment in which it will be used, while providing a rugged carrier for the batt fibers.

"Elastic carrier layer": a layer or generally planar sheet of a somewhat elastic, stretchable material typically provided as an assembly of one or more individual panels of the same material joined in side-by-side relation. The carrier layer may be comprised of one of: an elastomeric membrane, a permeable film, an elastic nonwoven mesh, or a woven assembly of stretchable elastomeric yarns such as polyurethane yarns; it is preferably comprised of a nonwoven, loosely bonded fibrous scrim such as a web of fine polyamide fibers. One example is a Cerex PA-6/6 scrim (part no. G31-25-96). An array of yarns [a yarn assembly, see below] can be bonded to the elastic carrier layer in a lamination or similar process. The elastic carrier layer is provided in lengths sufficient to cover the CD width of the base fabric into which it will be installed, and in a width or plurality of widths that are joined together sufficient to extend over preferably 90% to 99% of the MD length of the base fabric (i.e. the elastic carrier layer must be capable of stretching in a preferred range by at least 1% to 10% of the MD length of the base fabric so as to cover the interior or exterior MD surface length). Additional preferred physical properties of the carrier layer are as described below.

"Yarn assembly": one or more strips or panels comprising an array of yarns, typically single or cabled monofilaments, bonded or laminated onto sheet or strip of an elastic carrier layer in mutually parallel relation with regular spacing. The yarn assembly is formed or assembled from a plurality of yarn panels to an MD length that is preferably 90% to 99% of the MD length of the base fabric or first fabric structure.

"Yarn panels": panels comprising an array of yarns, typically single or cabled monofilaments, bonded or laminated onto sheet or strip of the elastic carrier layer in mutually parallel relation with regular spacing.

Preferred Embodiments

Referring to FIGS. 6-20, several components as well as embodiments of seamless press felts 300, 300', 400, 400' (see FIGS. 16-20) according to the invention are shown. The embodiments may include a woven inner and outer base fabric layers 100A', 100B' (FIGS. 6, 12) or nonwoven inner and outer base fabric layers 100A, 100B (FIGS. 7, 8, 10A-10C, and 11) formed as continuous tube structure having an MD length and a CD width and at least MD yarns 110. An elastic intermediate yarn assembly 200 (FIGS. 9 and 13-15) formed as a continuous tube structure and having at least CD yarns 210 is "socked" between the inner and outer base fabric layers 100A, 100B; 100A', 100B', to form an assembled base fabric structure 250 and at least one layer of a fibrous batt material 266 is needled to the assembled base fabric structure 250.

Figure 6:
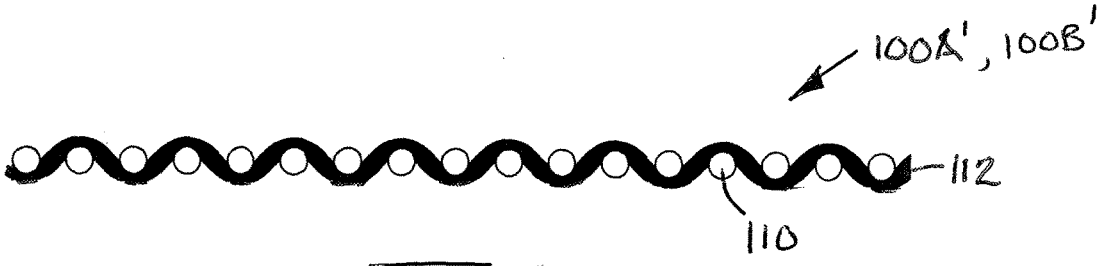
FIG. 6 is a cross-section of an exemplary woven inner or outer base layer fabric for use with the seamless press felts according to the present invention.

In one embodiment of the inner and outer base fabric layers 100A', 100B' are woven as shown in FIG. 6. The inner and outer base fabric layers 100A', 100B' can have the same woven structure with interwoven MD yarns 110 and CD yarns 112. The weave pattern shown in FIG. 6 is a plain weave. However, other weave patterns could be utilized and different yarn sizes could be used for the inner and outer base fabric layers 100A', 100B'. The MD yarns 110 are generally continuous as they extend around the MD length of the inner and outer base fabric layers 100A', 100B'.

Figure 12:
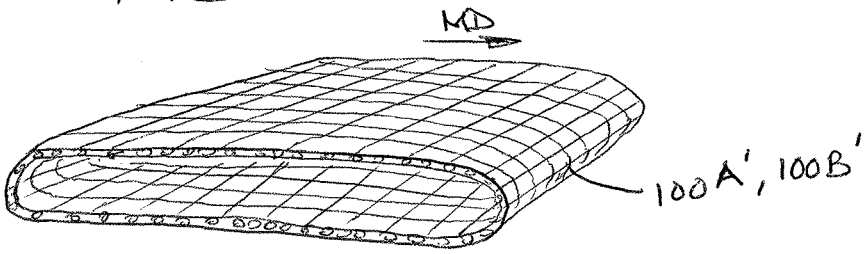
FIG. 12 is a schematic illustration of one of an inner or outer base layer formed as a continuously woven fabric tube.
Figure 18:
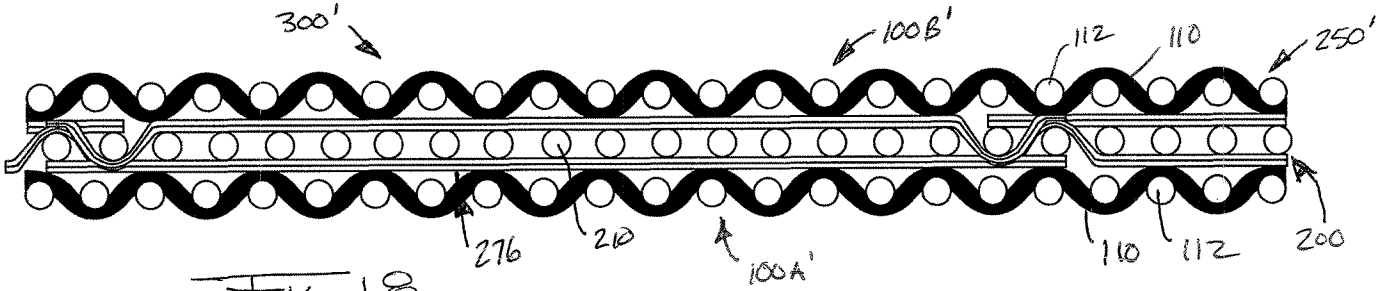
FIG. 18 is an enlarged cross-sectional illustration of the press felt base fabric presented in FIG. 16 showing the elastic intermediate yarn assembly installed between the inner and outer base fabric layers, which are shown as woven fabric layers.
Figure 19:
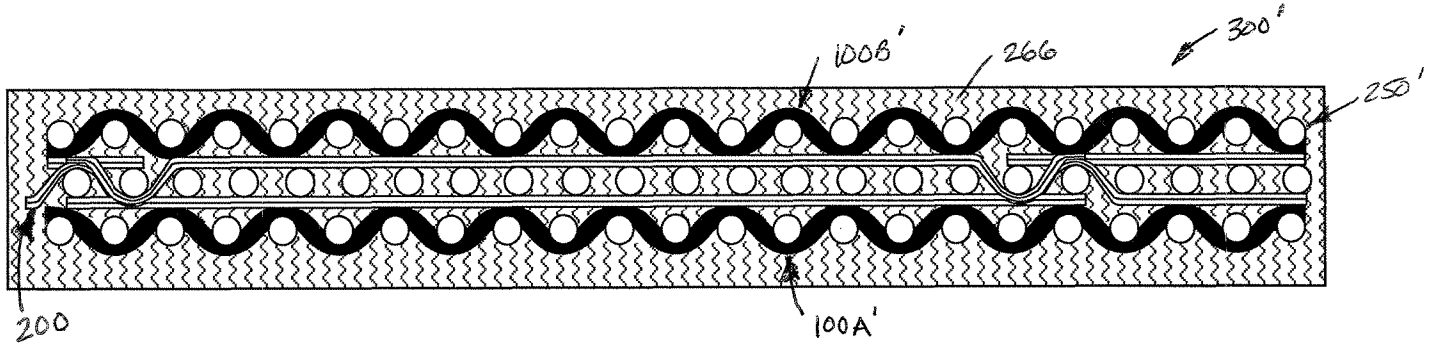
FIG. 19 is an enlarged cross-sectional illustration of the press felt base fabric presented in FIGS. 16 and 18 following needling of one or more layers of a fibrous batt material to the press felt base fabric.

As shown in FIG. 12, the inner and outer base fabric layers 100A', 100B' could be endlessly woven to a full size of the MD length and CD width of the seamless press felt. Alternatively, woven strips of a base fabric structure having a selected width [of about 1 m] can be produced and spirally wound in a longitudinal direction at a small angle, which is generally about 5° or less to the MD, according to known techniques so as to build up a continuous tube that is open in the center. Adjacent edges of successive turns of the first fabric structure are bonded to one another by one of welding, stitching or other known bonding means as they are spirally wound. This can be done, for example, in a similar manner to the construction discussed in connection with FIG. 11. The finished tube forms the inner base fabric layer or the outer base fabric layer, 100A', 100B' in the assembled base fabric structure 250', for example as shown in FIGS. 18-19.

Alternatively, the inner and outer base fabric layers 100A, 100B can be formed of a nonwoven fabric structure as shown in FIGS. 7, 8, and 10A-10C formed of a first array of MD yarns 110. The first array is comprised of MD yarns 110 preferably having a first diameter or size and first yarn density (i.e. number of yarns per unit length). The first array is "sandwiched" between two sheets of an adhesive web 120, which has a first melting temperature. The first array and adhesive web 120 are together sandwiched between two layers of an elastic carrier layer 130, preferably a fine fibrous scrim material, which has a second melting temperature that is higher than the first. The first array, together with the adhesive webs 120 and fibrous scrims 130, are subjected to heat and pressure in a hot lamination process, the heat sufficient to melt the adhesive webs and bond the yarns of the first array to the fibrous scrim to provide a generally planar and cohesive first fabric structure; the fibrous scrim 130 material imparts cohesive strength to the first array and its component fibers act to enhance the dewatering performance of the completed press felt.

A continuous length of this first fabric structure having a selected width [of about 1 m] is produced and is spirally wound in a longitudinal direction at a small angle, which is generally about 5° or less to the MD, according to known techniques so as to build up a continuous tube that is open in the center. Adjacent edges of successive turns of the first fabric structure are bonded to one another by one of welding, stitching or other known bonding means as they are spirally wound. This can be done in the manner illustrated in FIG. 11. The finished tube forms the inner base fabric layer or the outer base fabric layer, designated 100A and 100B in the assembled base fabric structure 250, for example as shown in FIG. 16.

A second fabric structure shown in FIGS. 9 and 13-15 forms the elastic intermediate carrier layer 200. This is prepared using an array of CD yarns 210, which may be either monofilaments or multicomponent yarns such as multifilaments or cabled monofilaments preferably having a second diameter or size equal to or less than that of the MD yarns 110, and arranged at a selected second yarn density which is preferably equal to or greater than the first yarn density. However, it could be less than the first yarn density depending on the particular application and requirements. The second array of CD yarns 210 is sandwiched between two sheets of the adhesive web 220 having a first melting temperature. The second array and the sheets of adhesive web 220 are then together sandwiched between two layers of an elastic carrier layer 230, preferably also in the form of a fine fibrous scrim material, which has a second melting temperature that is higher than that of the adhesive web 220. The second array, together with the adhesive webs 220 and fibrous scrim 230, are then subjected to pressure and heat sufficient to melt the adhesive web and bond the CD yarns 210 of the second array to the fibrous scrim 230 to provide a cohesive generally planar yarn assembly, which is used as a second fabric structure. Multiple strips of selected length of the second fabric structure are then assembled edge to edge by joining adjacent strips to one another to build up a desired width and finally connected together to form a tube structure that is the elastic intermediate yarn assembly 200. Various bonding means such as welding, gluing or stitching may be employed for this purpose. This can be done, for example, in the manner discussed below in connection with FIGS. 13 and 15.

Figure 16:
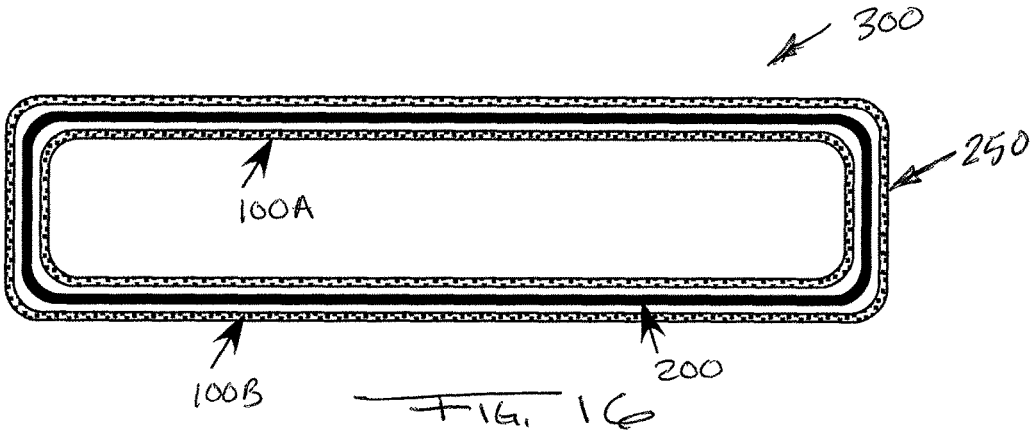
FIG. 16 is a cross-sectional illustration showing the press felt base fabric with the elastic intermediate yarn assembly installed between the inner and outer base fabric layers, prior to being assembled by the needling of one or more batt layers thereto.

During assembly of the base fabric structure 250, the elastic intermediate carrier layer 200 is located between the inner and outer base fabric layers 100A, 100B, as shown in FIG. 16, or between the woven inner and outer base fabric layers 100A', 100B' as shown in FIG. 18 to form the press felt base fabric structure 250'. The fabric layers 100A, 200, and 100B are then connected together in a needling process to form a press felt 300, 300' by needling one or more layers of a nonwoven fibrous batt material 266 into and through the assembly.

The needled base fabric assembly is then subjected to heatsetting and various other known finishing steps so as to stabilize it. Following these steps, the finished nonwoven press felt 300, 300' is ready for installation in the press section of a paper machine designed to receive a seamless press felt.

Figure 2:
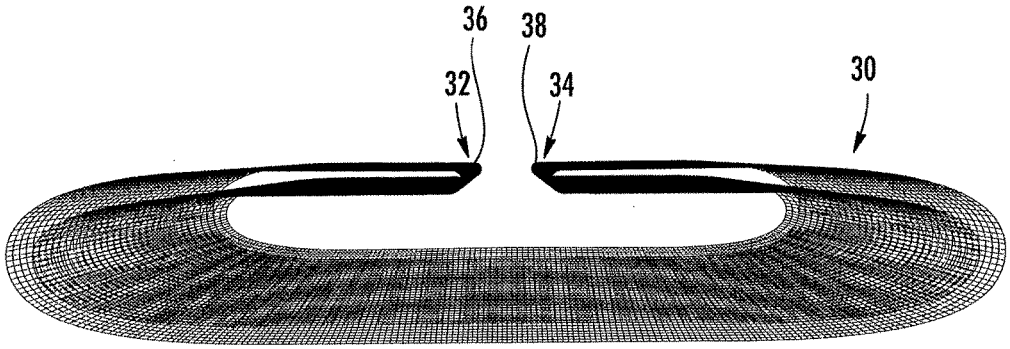
FIG. 2 PRIOR ART
FIG. 2 is a view of a continuous tube-like base fabric 30 including opposing fold regions 32 and 34; fabric 30 may be made from successive turns of the narrow fabric 10 in the manner illustrated in FIG. 1, or it may be produced by a modified endless weaving process, a flat weaving process where opposing ends of the flat woven cloth are joined to provide a continuous tube, or it may be a nonwoven cohesive assembly of yarns oriented in the length direction around the tube.

The inner and outer base fabric layers 100A, 100B (and optionally 100A', 100B') may be assembled using a spiral winding process generally as described in U.S. Pat. No. 5,268,076 to Best et al. and U.S. Pat. No. 5,360,656 to Svensson et al., both of which are incorporated herein by reference as if fully set forth. FIG. 1 provides a schematic illustration of this process. As shown in FIG. 1, a length of textile material 10 is paid off a spool 20 or from a similar source and is spirally (or helically) wound about two opposing rollers 22, 24 so that the longitudinal edges of each successive turn either abut or overlap one another. During assembly, each adjacent turn is bonded to the next by a chosen bonding process, such as stitching, welding, gluing or other suitable means. The prior art textile material 10 used for this purpose was typically a woven textile produced on a high speed narrow loom, either as the spirally wound fabric is made, or as stock material prior to the spiral winding process. Each adjacent turn of material is laid parallel to the next and usually oriented or canted at a small angle to the intended longitudinal or eventual MD of the finished fabric as it is spirally wound. Once the desired width and length of spirally wound fabric has been obtained, the textile material is cut from the feed source and the loosely cohesive spirally wound fabric is removed from the spiral winding assembly apparatus. Following removal, the fabric may be laid flat to provide a double layer structure 30 with two opposing fold regions 32, 34 that define the respective ends 36, 38 so that the resulting tube-like base fabric now resembles that shown in FIG. 2. One of these tube structures is used to form each of the inner and outer base fabric layers 100A, 100B; 100A', 100B'.

Figure 3:
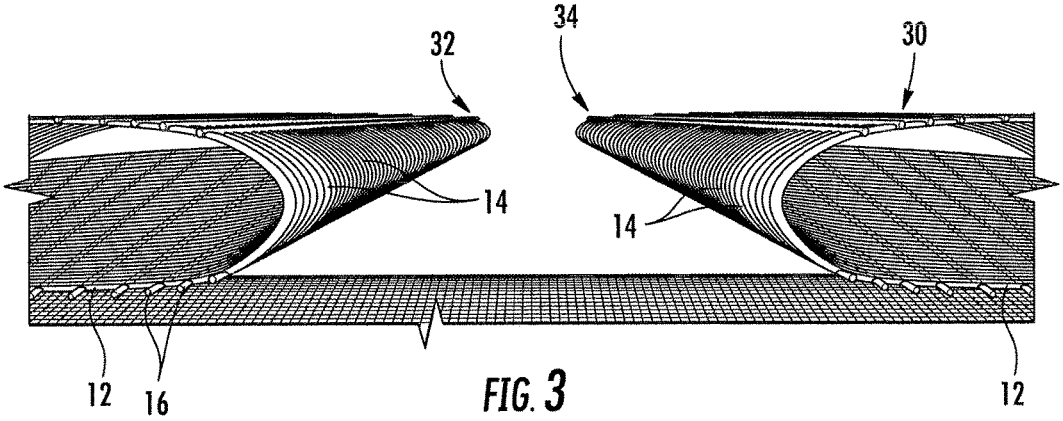
FIG. 3 PRIOR ART
FIG. 3 is an enlargement of the two folded edge regions of the base fabric presented in FIG. 2 which form the seam region in the prior art fabrics shown in FIGS. 1 and 2.
Figure 4:
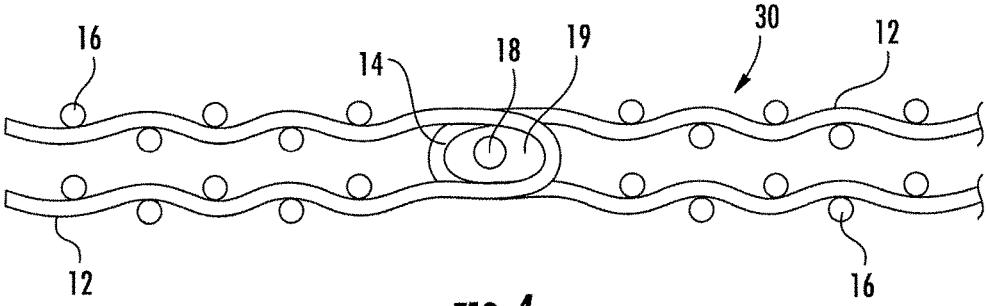
FIG. 4 PRIOR ART
FIG. 4 is a schematic illustration of the seam region in a prior art woven fabric such as presented in FIGS. 1 to 3 including a pintle to join the seam regions of the folded ends.
Figure 5:
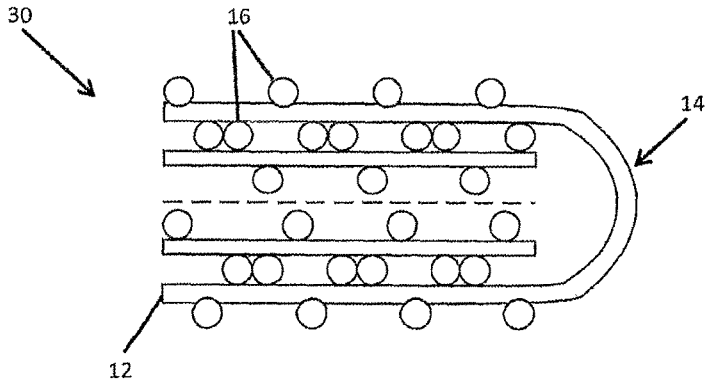
Figure 5 (Prior art)
FIG. 5 is an illustration showing a cross-section through a prior art high void volume woven base fabric according to Lee U.S. Pat. No. 7,207,355 at the seam loop area. The fabric includes two sets of MD oriented yarns, one of which is cut at the seam region to provide continuous loops of the second set of MD oriented yarns. The fabric of FIG. 5 illustrates one means of providing a relatively high void volume seamed base fabric.

In accordance with one prior art arrangement as shown in FIG. 3, this tube can be collapsed to form a double layer base fabric structure in which the two opposing fold regions 32, 34 of the spirally wound double layer woven structure 30 have a portion of the CD oriented yarns 16 removed to expose yarn loops 14 formed by the MD oriented yarns 12 of the structure for seaming using a pintle 18. FIG. 5 shows another prior art base fabric structure having an end prepared for seaming. However, this seaming preparation requires extra manufacturing steps and results in a seamed press felt that may suffer from one or more of the issues noted above.

Figure 7:
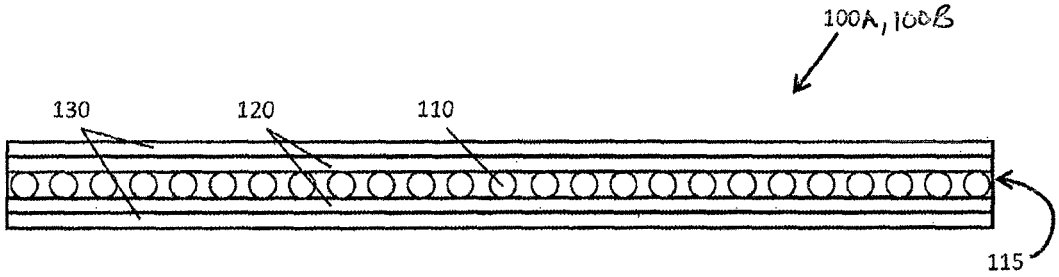
FIG. 7 is a diagrammatic illustration of a cross-section across the MD yarns of a nonwoven first fabric structure which may be used as a base fabric layer for a seamless press felts according to the present invention.

FIG. 7 presents a cross-section taken across the yarns 110 in a first yarn array 115 of a first fabric structure that can be used to form the inner and outer base fabric layers 100A, 100B. The inner and outer base fabric layers 100A, 100B are spirally wound in the manner described in relation to FIG. 1 so that the yarn array 115 is oriented at a small angle, typically from about 1° to 5° to the longitudinal direction, or MD, of the base fabric. As shown in FIG. 7, the inner and outer base fabric layers 100A, 100B are provided as a continuous strip of an array 115 of polymeric monofilament MD yarns 110 each of which is parallel to the next and regularly spaced apart at a desired spacing, which spacing may be adjusted according to need.

Figure 8:
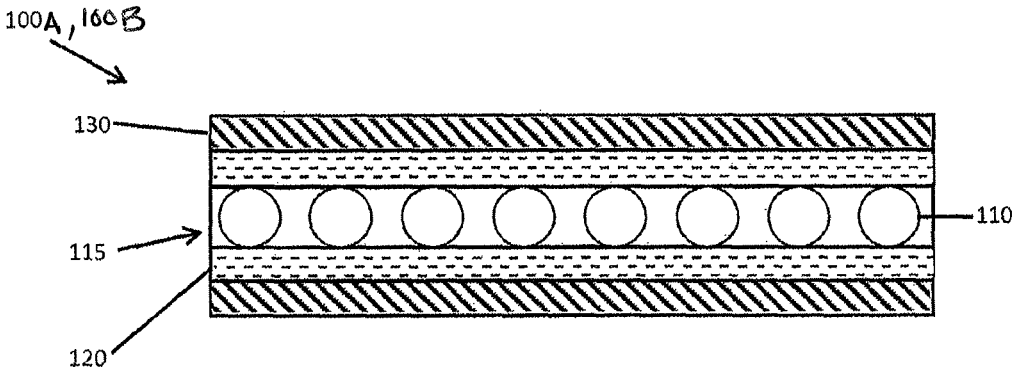
FIG. 8 is an enlarged view of the first fabric structure used as a base fabric layer shown in FIG. 7.

FIG. 8 shows details of a particularly preferred construction of the inner and outer base fabric layers 100A, 100B presented in FIG. 7. As shown, the yarns 110 of the first array 115 are "sandwiched" between two layers of a hot melt adhesive web material 120 to retain them in a desired position. SpunFab™ copolyamide thermoplastic adhesive, identified by part number FA1200-090-040 and available from Spunfab, Ltd. of Cuyahoga Falls, Ohio has been found to be suitable for this purpose; other adhesives, including thermoset adhesives, may also be satisfactory. The preferred thermoplastic adhesive is heat activated and has a first melting temperature; it provides a bond sufficient to bind the yarns 110 of the first array 115 in their desired positions to a fine fibrous scrim 130.

The first array 115 and adhesive web 120 are then sandwiched between two layers of an elastic carrier layer, preferably in the form of a fine fibrous scrim 130, which is significantly more robust than the adhesive web 120; the fibrous scrim 130 provides cohesive strength to the array 115 to which the yarns 110 are bonded by the adhesive web 120, and this strength is sufficient to enable subsequent processing of the array during assembly. One particularly preferred scrim is Cerex PA-6/6 (polyamide 6-6) scrim, part no. G31-25-96 available from CEREX Advanced Fabrics, Inc.

of Cantonment, Fla.; other scrim materials may also be suitable. The Cerex PA-6/6 scrim is a fibrous web of continuous fine PA-6/6 fibers having a dtex in the range of from 1 to 10 that are thermally bonded together to provide a drapable textile-like fabric and is available from the manufacturer in rolls about 1 m in width. The product is available in a range of air permeabilities from about 100 cfm (~1,560 m3/m2/hr) and may range as high as 2000 cfm (~31,200 m3/m2/hr), or more. The Cerex scrim is also available from the manufacturer in various weights of from 0.30 to 4.0 osy (ounces per square yard) and has a tensile strength in this weight range of from about 5 lb/in up to about 160 lb/in. (as determined by ASTM D5034), making it suitable to increase the strength and robustness of the first array for handling. One particularly preferred fibrous scrim has a weight of about 0.50 osy (16.9 g/m2) (as determined by ASTM D3776) and has an air permeability of about 1,516 CFM (23,400 m3/m2/hr). Scrim materials having weights greater than this may be useful in the production of press felts with relatively lower air permeability.

This fibrous scrim 130 appears to provide a further and somewhat surprising benefit in that the small component fibers appear to act similarly to a fine batt material and assist to enhance the dewatering effect of the press felts of the invention. The fine fibers are effective in wicking moisture from the batt into the interior of the felt where it is subsequently removed by vacuum after transporting water from the sheet. In addition to providing structural support to the first and second fabric structures, the fibrous scrim thus appears to enhance the dewatering capability of the press felts of the present invention.

The yarns 110 of the first array 115 are preferably monofilaments comprised of a polyamide polymer. Alternatively, cabled monofilaments could be used as some or all of the yarns 110 of the first array. Polyamide-6 (also known as nylon 6 or PA-6) is presently preferred for this purpose due to its "toughness", resistance to degradation due to environmental effects, and tensile strength, although other polyamide materials may prove suitable. The CD yarns of the CD array may be comprised of polyamide-6/10 (PA-6/10). In one preferred arrangement, the MD yarns are monofilaments, and the CD yarns are cabled monofilaments. The yarns 110 of the first array 115 will be oriented, following assembly of the inner and outer base fabric layers 100A, 100B in the spiral winding process, at a small angle of from about 1° to about 5° to the intended MD of the completed press felt. The number of MD yarns per unit width (yarn density) in the inner and outer base fabric layers 100A, 100B is preferably in the range of from 15-40 yarns/inch (5.9 to 15.7 yarns/cm); as shown in FIG. 8, the yarn density in the first preferred embodiment of the array 115 of the inner and outer base fabric layers 100A, 100B is 18 yarns/in. (7.1/cm). The yarn density of the inner and outer base fabric layers 100A, 100B is preferably selected to present an "open" structure to the PS surface of the press felt to maximize water removal, permeability and void volume in the completed press felt. The MD yarns 110 have to carry the tensile load on the press felt in operation and are therefore generally stronger than the CD yarns.

For this reason, the MD yarns 110 of the inner and outer base fabric layers 100A, 100B are arranged as a first planar yarn array, and are preferably of a different size to the CD yarns 210 in the elastic intermediate yarn assembly 200 and are preferably larger; monofilaments having a preferably circular cross-sectional shape and a diameter of from about 0.3-0.6 mm are suitable; circular cross-section monofilaments having a diameter of 0.5 mm are presently particularly preferred for this purpose.

In an alternate preferred arrangement, the yarns of the CD array are made of polyurethane filaments, which can be 100% polyurethane, or a polyurethane sheath located over a polyamide, preferably nylon, core. These polyurethane filaments preferably have a diameter of 0.2 mm to 1.0 mm.

The adhesive web 120, first array 115 and fine fibrous scrim 130 are assembled in the manner shown in FIG. 7 and then heated under pressure in a continuous hot lamination process to a temperature sufficient to melt the adhesive web 120 so as to bond the yarns 110 in the first array 115 together to the fibrous scrim material 130 and thus retain them at the desired orientation and yarn density. In a preferred assembly, this heating temperature is in the range of from about 220° F. to about 280° F. (104° C.-138° C.). Selection of appropriate heating temperature sufficient to melt the adhesive web 120 will be dependent on the speed by which the fabric structure is moved through the lamination process. During and following the lamination process, a portion of the adhesive web 120 melts and effectively dissipates into the fabric structure, leaving behind the first array 115 and fibrous scrim material 130 as the first fabric structure 100. This assembled and laminated first fabric structure 100 will preferably have an air permeability that is in the range of from about 200 to about 400 CFM (3120 to 6240 m3/m2/hr) when a fibrous scrim 130 having a weight of about 0.50 osy (16.9 g/m2) and air permeability of about 1,516 CFM (23,400 m3/m2/hr) is used in combination with a yarn density of about 18 yarns/in. (7.1/cm) and diameter of 0.5 mm for the yarns 110. An alternative first fabric structure could be an extruded or molded arrangement with the MD filaments/yarns embedded into the structure, such as a layer of pure polyurethane.

Figure 9:
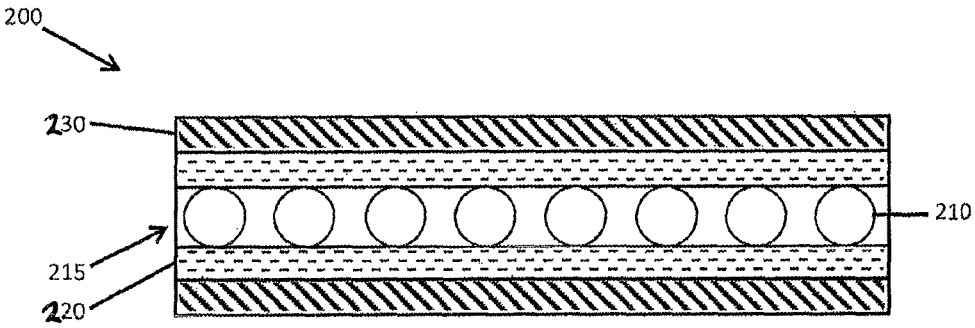
FIG. 9 is an enlarged view diagrammatic illustration of a cross-section across the CD yarns of a nonwoven second fabric structure used as an elastic intermediate layer in a seamless, nonwoven press felts according to the present invention.

FIG. 9 shows details of a particularly preferred construction of a part of the elastic intermediate yarn assembly 200, which is similar to that presented in FIG. 7, except that the CD yarns 210 in the array 215 are preferably smaller in diameter or size and arranged at higher density than the yarns 110 in the first array 115 of the inner and outer base fabric layers 100A, 100B. As shown, the CD yarns 210 of the second array 215 are "sandwiched" between two layers of a hot melt adhesive web 220, that is preferably the same material as the adhesive web 120 to retain them in a desired position. The adhesive web 220 is preferably a SpunFab™ copolyamide thermoplastic adhesive, part number FA1200-090-040 available from Spunfab, Ltd. of Cuyahoga Falls, Ohio and which is heat activated is particularly preferred, although other adhesives may prove satisfactory. The second array 215 and adhesive web 220 are then sandwiched between two layers of an elastic carrier material 230, preferably in the form of the fine fibrous scrim material which provides cohesive strength to the array and adhesive; Cerex PA-6/6 scrim, part no. G31-25-96 available from CEREX Advanced Fabrics, Inc. described above is particularly preferred for this purpose, although other fabric scrims may prove suitable.

The CD yarns 210 of the second array 215 used in the yarn assembly 200 are preferably also monofilaments, but could also be cabled or other multicomponent yarns, or combinations of monofilaments, cabled and/or multifilament yarns, and are preferably comprised of a polyamide polymer; for this application, yarns comprised of polyamide-6/10 (or PA-6/10, or nylon 6/10) are presently preferred due to their dimensional stability when exposed to varying moisture levels, although other types of polyamide yarns may prove suitable. The CD yarns 210 of the second array 215 will be oriented, following assembly of the elastic intermediate yarn assembly 200 with the inner and outer base fabric layers 100A, 100B as described in detail below, in the intended CD of the completed press felt 300, 300'. The yarn density of the second array 215 will preferably be higher than that in the first array 115 and will preferably be in the range of from about 21 to 30 yarns/in. (8.3 to 11.8 yarns/cm) when selected in conjunction with the yarn density of the first array 115 so that the chosen value meets this criterion. As shown in the construction presented in FIG. 9, in a particularly preferred arrangement of the second array 215 for use with the preferred arrangement of the first array 115, the yarn density is 24 yarns/in (9.45 yarns/cm). Alternatively, the CD yarns 210 of the second array 215 may be provided at a density equal to, but not less than, the yarn density of the first array 115, i.e. 15 to 40 yarns/inch (5.9 to 15.7 yarns/cm). Also as shown, the size or diameter of the yarns 210 in the second array 215 is smaller than that of the MD yarns 110 in the first array 115; monofilaments having a circular cross-sectional shape and a diameter of about 0.4 mm are presently preferred for this purpose when used in combination with larger yarns 110 in the first fabric structure 100. It would also be possible to use cabled monofilaments as the yarns 210 of the second array 215. If this is done, then the component monofilaments should have a diameter, d, in the range of 0.1 to 0.3 mm, and may be cabled in one of a d×2×2, d×2×3 or d×3×3 arrangements. The effective diameter of these cabled yarns (i.e.: the outside diameter of the cabled assembly) is preferably selected so as to be less than or equal to the diameter of the single monofilament MD yarns 110 in the first array 115. The CD yarns 210 of the elastic intermediate yarn assembly 200, when assembled with the inner and outer base fabric layers 100A, 100B in the completed press felt, provide a CD oriented support surface to the fabric and paper conveyed; they thus should be provided as comparatively smaller yarns (in relation to those in the inner and outer base fabric layers 100A, 100B) and arranged at a higher density than those in the inner and outer base fabric layers 100A, 100B. Although monofilaments can be used satisfactorily, cabled or other multicomponent yarns will provide improved batt anchorage, which may be necessary in certain applications. Also, certain applications may dictate that the yarn density and size in the second array 215 be equal to that in the first array 115. An alternative elastic intermediate yarn assembly 200 could be an extruded or molded arrangement with the CD filaments/yarns embedded into the structure, such as a layer of pure polyurethane. The elastic intermediate yarn assembly 200 can be assembled from multiple sections, as discussed below in connection with FIGS. 13-15.

FIG. 10A is a planar view of a portion of the inner and outer base fabric layers 100A, 100B shown schematically in FIGS. 7 and 8. In FIG. 10A, the first yarn array 115 is comprised of a plurality of single MD monofilaments 110 having the desired size and a selected regular spacing which are bonded together between two layers of the fine fibrous scrim material 130 using two layers of a hot melt adhesive web (not shown) to retain them in a desired position on the scrim. The first array 115, adhesive web and fibrous scrim 130 are bonded together in a hot lamination process employing heat and pressure as previously described to form the first fabric structure 100 which, following preparation, is sufficiently robust and cohesive so as to allow subsequent handling and assembly. As previously mentioned, the fine fibers in the fibrous scrim 130 also provide a type of precursor batt material which may later offer benefits to the assembled press felt with respect to improved dewatering and batt anchorage. FIGS. 10B and 10C show a CD cross-section and a side view taken along one of the MD monofilaments 110, respectively.

A continuous length of this first fabric structure as described above can then be spirally wound and assembled in a known manner as shown in FIGS. 1-3 and 11, to provide the inner and outer base fabric layers 100A, 100B in the form of a continuous tube. As shown in FIG. 11, the MD yarns 110 of the first fabric structure 100 are oriented left to right across the Figure in the longitudinal or lengthwise direction of the spirals and are canted at a small angle to the intended MD of the finished fabric.

Figure 15:
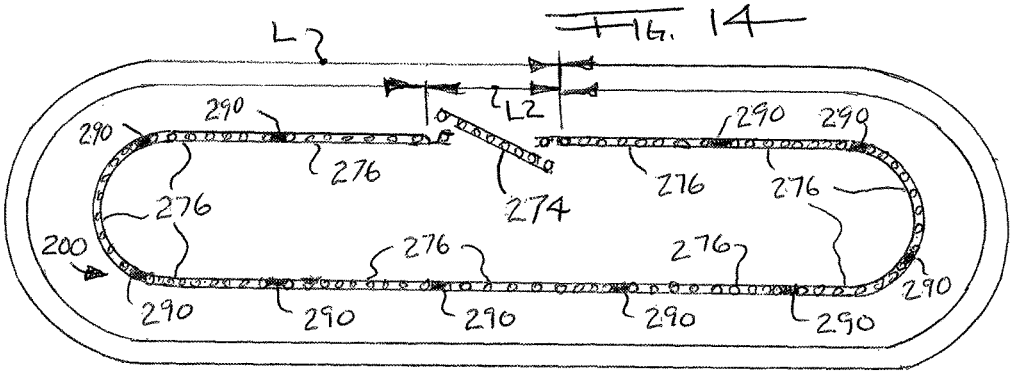
FIG. 15 is a schematic view taken along an MD edge of the assembled elastic intermediate yarn assembly showing a connector panel that is sized to a correct MD length that is 1% to 10% less than an MD length of the inner and outer base layers being installed to complete the tube-shaped structure of the elastic intermediate yarn assembly.

The elastic intermediate yarn assembly 200 is prepared with a length L, shown in FIG. 15, that is from 1% to 10% less than the MD length of the inner and outer base fabric layers 100A, 100B; 100A', 100B'. The elastic intermediate yarn assembly 200, is then stretched during assembly where it is "socked" between the inner and outer base fabric layers 100A, 100B; 100A', 100B' and expanded by between 1% and 10% of its relaxed length, ensuring that any creases, folds or other deviations from generally planar are removed.

In the embodiments shown in FIGS. 16 and 19, one or more layers of a fibrous batt material 266 (not shown in FIG. 16) are needled into the three-layer assembly that forms the base fabric structure 250, 250' using known techniques common to the manufacture of press felts. The fibrous batt material 266 is typically a selected mixture of polyamide fibers such as is known in the art; it is possible that a portion of these fibers may be bi-component in nature and include an adhesive component which, during subsequent fabric processing, melts to provide improved surface fiber retention and smoothness to the resulting fabric.

Figure 17:
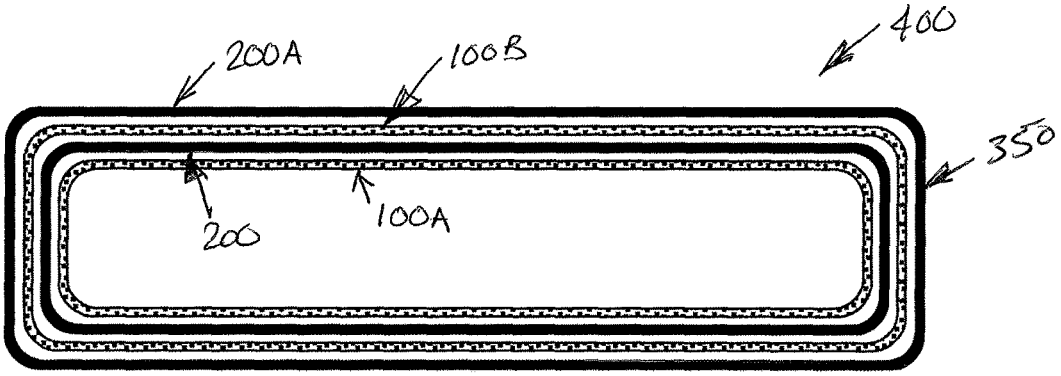
FIG. 17 is a cross-sectional illustration of another embodiment of the press felt base fabric with the elastic intermediate yarn assembly installed between the inner and outer base fabric layers, along with a second elastic yarn assembly formed as an endless tube installed outside of the outer base fabric layer, prior to being assembled by the needling of one or more batt layers thereto.
Figure 20:
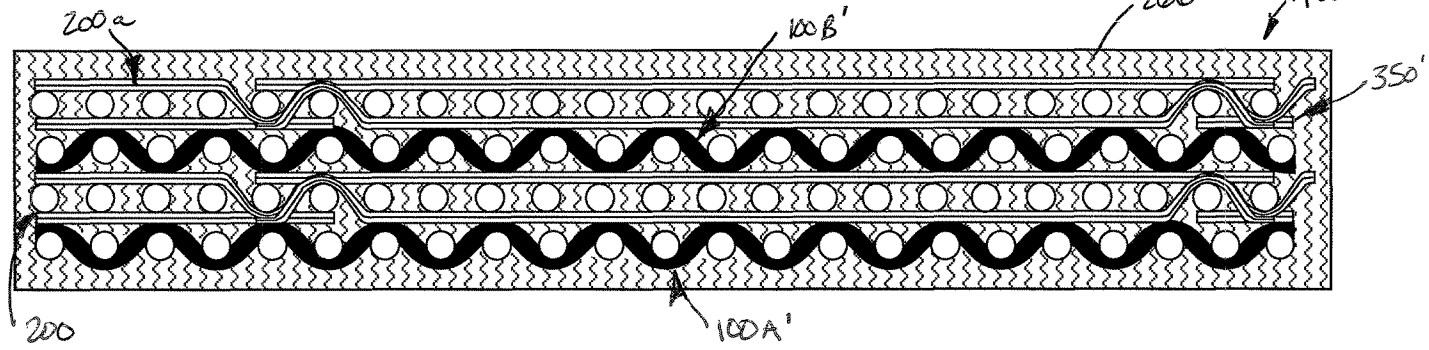
FIG. 20 is an enlarged cross-sectional illustration of the press felt base fabric presented in FIG. 17 following needling of one or more layers of a fibrous batt material to the press felt base fabric.

FIGS. 17 and 20 present second embodiments of a press felt 400, 400' according to the present invention that are similar to the previous embodiments 300, 300' and in addition have another elastic intermediate yarn assembly 200*a* located, or "socked", over an exterior surface of the outer base fabric layer 100B, 100B'.

As shown in FIGS. 17 and 20, the base fabric structure 350 of press felt 400 shown schematically in FIG. 17 (without the batt material 266) includes the inner and outer base fabric layers 100A, 100B with the elastic intermediate yarn assembly 200 located therebetween. A second elastic intermediate yarn assembly 200*a* (constructed in the same manner as the elastic intermediate yarn assembly 200 and also having a length that is 1% to 10% less than the MD length of the inner and outer base fabric layers 100A, 100B) including yarns 210 is located on top of the yarns 110 of the outer base fabric layer 100B. The yarns 210 of the elastic intermediate yarn assemblies 200, 200*a* are both arranged perpendicularly to the MD oriented yarns 110 in the first and second base fabric layers 100A, 100B.

FIG. 20 provides a more detailed illustration of the press felt 400' constructed in the same manner as the press felt 400, but using the woven inner and outer base fabric layers 100A', 100B'. The second elastic intermediate yarn assembly 200*a* is provided as a continuous loop and is located around the exterior of the outer base fabric layer 100B'. One or more layers of a fibrous batt material 266 are then needled into the assembly.

Thus, the press felts 400, 400' provide a four-layer base fabric structure 350, 350', consisting of inner and outer base fabric layers 100A, 100B; 100A', 100B' with the elastic intermediate yarn assembly 200 located therebetween, and the second elastic intermediate yarn assembly 200*a* located on the exterior.

Regardless of how the inner and outer base fabric layers 100A, 100B; 100A', 100B' are formed, they are a seamless tube structure.

A preferred construction of the second fabric panel 200 for use in connection with the above embodiments of the invention as well as for use in connection with inner and outer base fabric layers 100A, 100B; 100A', 100B' is described in detail below.

Figure 13:
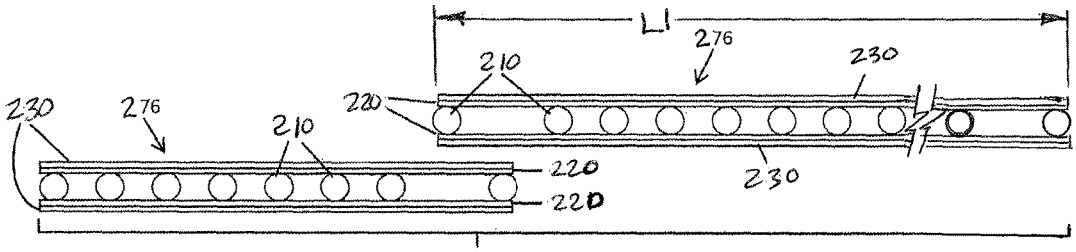
FIG. 13 is a cross-section taken along an MD edge of the elastic intermediate yarn assembly including field yarn panels formed of an elastic carrier layer and regularly spaced monofilament yarns laminated to the elastic carrier layer. The spacing of the yarns at the edge regions of each of the two separate yarn panels has been adjusted to allow for the formation of a lap join (FIG. 14) allowing two adjacent yarn panels to be joined together during formation of the generally planar yarn assembly.
Figure 14:
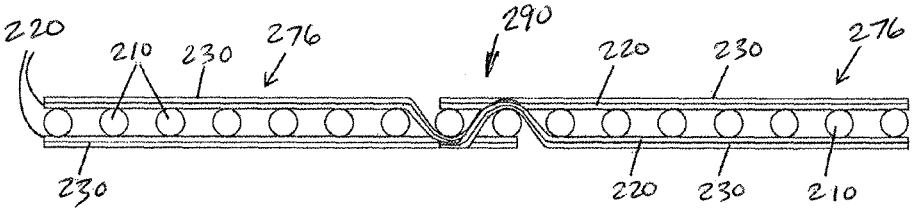
FIG. 14 shows the lap join between two adjacent field yarn panels of the elastic intermediate yarn assembly.

Referring to FIGS. 13-15, the elastic intermediate yarn assembly 200 includes the array 215 of mutually parallel and regularly spaced polymeric yarns 210. These yarns 210 are bonded to the elastic carrier material 230 in a single layer. The yarns 210 are preferably single or cabled monofilaments, and are preferably comprised of a polymer selected from a polyamide or a polyurethane. The spacing of the yarns 210 can be adjusted in order to adjust a void volume of the press felt 300, 300', 400, 400'. The elastic carrier material 230 is comprised of a stretchable material in the form of one of: an elastomeric membrane, a permeable film, an elastic nonwoven mesh or web, a woven assembly formed of elastomeric yarns such as polyurethane yarns, a knitted material, or, preferably, a nonwoven loosely bonded fibrous scrim formed of continuous fibers. The elastic carrier material 230 is capable of stretching, under uniformly applied tension, by an amount equal to at least 1%, and as much as 10% or more of its relaxed length without rupture. Here, the preferred elastic carrier material 230 is the Cerex PA-6/6 scrim (part no. G31-25-96) available from CEREX Advanced Fabrics, Inc. of Cantonment, Fla.; however, other materials, such as an extruded mesh or film having similar elastic properties may prove suitable, for example, such as Conwed extruded webbing (urethane), perforated urethane film, Albany Apertec perforated urethane webbing, Voith Spectra urethane membrane, or warp and weft knit polyamide. This is preferably connected to the upper and lower sides of the yarns 210 using adhesive layers 220, which are preferably a heat activated or hot melt adhesive. It is noted that the spacing of the yarns 210 can also be adjusted, at least in part, by the stretching of the elastic carrier material 230.

The elastic intermediate yarn assembly 200 is preferably assembled in a modular manner using a plurality of yarn panels 276 that are connected edge to edge at connection areas 290 as shown in FIGS. 13 and 14, and the ends are then connected using a connector yarn panel 274 which can be tailored to achieve a desired length L. The elastic intermediate yarn assembly 200 is preferably assembled using an appropriate whole number of the yarn panels 276 based on their individual lengths L1 totaling up to a total length that is less than or equal to a distance L1 from the desired length L. A connector panel 274 is then constructed having a length L2 that is less than or equal to the length L1, so that once connected, the elastic intermediate yarn assembly 200 will have the desired length L, which is 1% to 10% less than a MD length of the inner and outer base layers 100A, 100B; 100A', 100B'. The yarn panels 276 are bonded together in side by side relation at the connection areas 290 as shown in FIGS. 13 and 14. When installed, the yarn panels 274, 276 are oriented so that all of the yarns 210 are directed in the CD direction in the press felt 300, 300', 400, 400'. The yarn panels 276 are prepared so that the spacing of the yarns 210 is maintained, for example by removing one yarn 210 that is spaced in from an MD edge of the yarn panel 210, so that when two of the panels 276 are bonded together, the yarn spacing is maintained. The yarn panels 276 are bonded together with a bonded connection, which can be formed by an ultrasonic weld.

The resulting assembly, now comprising the two continuous base fabric material layers 100A, 100B; 100A', 100B' between which layers is located the elastic intermediate yarn assembly 200 to form a fabric tube that is ready for needling with a batt material 266 to form the press felt 300, 300' which is then ready for any subsequent fabric processing. Alternatively, a second elastic intermediate yarn assembly 200*a* can be attached to the exterior surface, if desired, with its yarns being oriented in the CD to form a fabric tube that is ready for needling with batt material 266 to form the press felt 400, 400' ready for any subsequent fabric processing.

As previously mentioned, the polymer from which the component yarns 110, 210 of the base fabric layers of the invention is made is preferably a polyamide, in particular polyamide-6, but other polyamides and copolymers thereof may prove suitable. It has also been found that yarn panels assembled from a plurality of laminated polyurethane monofilament yarn arrays may provide certain advantages due to their elastic compression properties; these may offer improvements in vibration resistance without detracting from the surface properties of base fabric. Additionally, polyurethane yarns will provide for better compression and rebound when appropriately spaced so as to leave lateral voids between each that allow the yarn to expand in width without producing vertical compression resistance. This, as well as increased void volume, can be quantified with various compression tests.

The elastic carrier material 230 is preferably a somewhat open, air permeable sheet or material. It must be capable of elastic deformation in at least one dimension by from 1% to at least 10% of its initial, relaxed length. It must be capable of accepting an adhesive bond such as would be formed by a hot melt adhesive. Although a nonwoven fibrous scrim such as described above has proven to provide satisfactory results, other permeable and elastically deformable materials may prove suitable.

The single or cabled monofilaments 210 are preferably comprised of a polyamide polymer; for this application, monofilaments comprised of polyamide-6/10 (or PA-6/10, or nylon 6/10) are preferred, however other polyamides and copolymers thereof may prove suitable. Monofilaments comprised of a polyurethane polymer may also be used. The monofilaments of each yarn panel 274, 276 are regularly arranged at a spacing of from about 21 to 30 yarns/in. (8.3 to 11.8 yarns/cm) depending on whether they are single or cabled yarns, and depending on the end use requirements of the press felt 300, 300', 400, 400' (e.g.: void volume, resiliency, compressibility, water handling and dewatering characteristics).

The elastic intermediate yarn assembly 200 such as has been described and which is preferably between inner and outer base fabric layers 100A, 100B; 100A', 100B', and optionally also on one exterior surface, offers numerous benefits to the press felts into which they are introduced, whether the base fabrics are woven (100A', 100B') or nonwoven (100A, 100B).

Elimination of interference patterns and improved surface uniformity—if the elastic intermediate yarn assembly 200 is located between the inner and outer base fabric layers 100A, 100B; 100A', 100B', and optionally on an exterior surface, it will effectively mask any interference patterns that may result from the overlay of two identical weave structures. Also, a nonwoven CD yarn array located between the inner and outer base fabric layers 100A, 100B; 100A', 100B' will prevent "nesting" of the component yarns from the two opposing surfaces when the press felt is under compression, thus improving surface uniformity of the resulting press felt 300, 300'. A similar effect is provided with the press felts 400, 400' by locating the elastic intermediate yarn assembly 200*a* on one or both exterior surfaces of the inner and outer base fabric layers 100A, 100B; 100A', 100B' in conjunction with the elastic intermediate yarn assembly 200 located in the interior as it will provide a flat layer of material which will prevent the nesting effect from being expressed on the exterior of the base. This is because the component yarns of the assembly are laid flat in the CD (perpendicularly to the MD yarns of the base fabric) and are bonded by lamination onto a flat carrier material.

Void volume—in the past, the common method used to increase the void volume of press felts was to increase the size/diameter of the component yarns of the base fabric. A problem with this approach, however, is that the larger yarns also occupy part of the void space they are intended to provide, so only small gains are actually realized. In the press felts according to the present invention, void volume is comparatively easily adjusted by inserting the elastic intermediate yarn assembly 200 either inside or outside the inner and outer base fabric layers. Adjustments to yarn size and spacing can be easily made prior to and during lamination; use of the resulting elastic intermediate yarn assembly 200 in this manner appears to provide a more open base fabric structure with higher (or lower) void volume as desired. Adjustments to the yarn spacing allow for larger yarns to provide the desired increase in void volume.

Uniform batt anchorage—As there is no seam, the strength of batt anchorage is uniform throughout, and is enhanced by the layers of elastic carrier material 130.

Improved water handling and nip dewatering—prior art press felts including a base fabric formed from single monofilament yarns are relatively incompressible and open. Use of a nonwoven yarn assembly in the locations previously described will improve compressibility characteristics of the resulting press felt 300, 300', 400, 400' resulting in improvements to nip dewatering; this performance may be enhanced through the use of polyurethane yarns as components of the yarn assembly.

Fabric Assembly Process:

The inner and outer base fabric layers 100A, 100B; 100A', 100B' including at least lengthwise MD yarns 110 are each prepared in the form of a textile tube of a desired MD length and width. In one embodiment, they are each formed by spirally winding a woven or nonwoven material strip as shown in FIGS. 1 and 11. However, it could be continuously woven fabric as shown in FIG. 12.

An elastic intermediate yarn assembly 200 preferably formed of a plurality of laminated yarn panels 276 and a connector yarn panel 274, each including an array of mutually parallel yarns 210 (preferably polymeric monofilaments, either single or cabled) is prepared as a continuous tube.

The component yarns 210 of each yarn panel 276 and connector panel 274 are arranged so as to be mutually parallel at a desired spacing. The panels 274, 276 are laminated under heat and pressure in a continuous process to an adhesive web 220 which is in turn bonded to a, preferably nonwoven, elastic carrier material 230 such as a fibrous scrim, nonwoven elastic web or lattice, or planar elastic film, to provide the yarn panels 274, 276. The elastic carrier material 130 imparts stretch to the resulting yarn panels 274, 276 so that they are stretchable in a direction essentially perpendicular to the orientation of the yarns 210 of the array in the plane of the panel.

A plurality of lengths of yarn panels 276 are prepared, each of which is cut to a length equal to the CD width of the base fabric layers 100A, 100B; 100A', 100B' into (or onto) which it is to be placed; a sufficient number of such lengths of panel material are provided and then joined and bonded edge to edge, indicated at 290 in FIGS. 14 and 15, with the connector panel 274 then connecting the first and last panels 276 together to form a tube having a length L that essentially extends the MD length of the inner and outer base fabric layers 100A, 100B; 100A', 100B', less 1% to 10% of that overall length. As the panels of the module are somewhat elastic, the elastic intermediate yarn assembly 200 is stretched to fit the interior MD length between the inner and outer base fabric layers 100A, 100B; 100A', 100B'. The yarns 210 in the lateral edges of each panel 274, 276 are arranged such that a lap joint can be formed in which the yarn spacing is continuous.

The now completed elastic intermediate yarn assembly 200 is "socked" between the inner and outer base fabric layers 100A, 100B; 100A', 100B'. See FIGS. 16 and 17.

The 3 layer assembled fabric 250, 250' thus includes the woven or nonwoven inner and outer base fabric layers 100A, 100B; 100A', 100B' inside of which is located the elastic intermediate yarn assembly 200, as shown in FIGS. 16 and 18. Optionally an additional elastic intermediate yarn assembly 200*a* can be located on the inner side and/or outer side of the 3 layer assembly to provide a 4 layer assembly 350, 350', as shown in FIGS. 17 and 20. The resulting base fabric structure 250, 250' is then needled to attach at least one layer of batt 266 material to at least one of the two opposing surfaces. See FIGS. 19 and 20. The resulting press felt 300, 300', 400, 400' is then conditioned using techniques known in the art so as to stabilize the entire assembly; following this, the press felt 300, 300', 400, 400' is ready for installation on the machine for which it is intended.

Having thus described the present invention in detail, it is to be appreciated and will be apparent to those skilled in the art that many physical changes, only a few of which are exemplified in the detailed description of the invention, could be made without altering the inventive concepts and principles embodied therein. It is also to be appreciated that numerous embodiments incorporating only part of the preferred embodiment are possible which do not alter, with respect to those parts, the inventive concepts and principles embodied therein. The present embodiment and optional configurations are therefore to be considered in all respects as exemplary and/or illustrative and not restrictive, the scope of the invention being indicated by the appended claims rather than by the foregoing description, and all alternate embodiments and changes to this embodiment which come within the meaning and range of equivalency of said claims are therefore to be embraced therein.

The invention claimed is:

1. A seamless press felt, comprising:

an outer base fabric layer, which can be woven or nonwoven, having an MD length and CD width including at least a first array of MD oriented yarns and is formed as a continuous unbroken tube structure;

an inner base fabric layer, which can be woven or nonwoven, having the MD length and the CD width and including at least a second array of MD oriented yarns and formed as a continuous unbroken tube structure, the inner base fabric layer is located within the outer base fabric layer;

an elastic intermediate yarn assembly including: a plurality of yarn panels, each said yarn panel including a CD array of mutually parallel and regularly spaced polymeric yarns, each bonded to an elastic carrier material that is extensible by at least 1% of a relaxed length thereof, the plurality of yarn panels being connected to adjacent ones of the plurality of yarn panels along opposing first and second edges thereof, and a connector yarn panel have a first edge that is connected to a first edge of a first one of the plurality of yarn panels and a second edge connected to a second edge of a last one of the plurality of yarn panels such that the intermediate elastic yarn assembly is formed as a continuous unbroken tube structure, the elastic intermediate yarn assembly being located between the inner and outer base fabric layers;

wherein the elastic intermediate yarn assembly has an MD length that is from 1% to 10% less than the MD length prior to assembly and is elastically stretched during assembly between the inner and outer base fabric layers, and a MD length of the connector yarn panel is adjusted to achieve the MD length of the elastic intermediate yarn assembly; and at least one batt layer needled through the inner and outer base fabric layers and the elastic intermediate yarn assembly to join the inner and outer base fabric layers and the elastic intermediate yarn assembly together.

2. The press felt according to claim 1, wherein the inner and outer base fabric layers are woven.

3. The press felt according to claim 1, wherein the inner and outer base fabric layers are non-woven.

4. The press felt according to claim 1, wherein the inner and outer base fabric layers are each one of an endless woven, modified endless woven, a multiaxial construction, or a non-woven construction.

5. The press felt according to claim 1, wherein the elastic carrier material is one of: an elastomeric membrane, a permeable film, an elastic nonwoven mesh, a woven assembly of elastomeric yarns, a knitted material, or a nonwoven loosely bonded fibrous scrim.

6. The press felt according to claim 1, wherein the elastic carrier material is a nonwoven loosely bonded fibrous scrim.

7. The fabric according to claim 6, wherein the nonwoven loosely bonded fibrous scrim material is a thermally bonded nonwoven open network of continuous polyamide fibers having a dtex in the range of 1 to 10, and an air permeability of from about 100 cfm (~1560 m3/m2/hr) to about 2,000 cfm (~31,000 m3/m2/hr) or more.

8. The press felt of claim 1, further comprising an additional one of the elastic intermediate yarn assemblies located on an external surface of the outer base fabric layer.

9. The press felt according to claim 1, wherein the connections are ultrasonic welds.

10. The press felt according to claim 1, wherein a void volume of the press felt is adjustable by adjusting a spacing between yarns in the array of yarns of the elastic intermediate yarn assembly.

11. The press felt according to claim 10, wherein the spacing is adjusted based on an amount of stretching of the elastic carrier material.

12. The press felt according to claim 1, wherein the elastic carrier material is stretched at least 2%.

13. The press felt according to claim 1, wherein at least one of the outer base fabric layer or the inner base fabric layer comprises a plurality of spirally wound turns of a fabric structure, the fabric structure including:

the array of MD oriented yarns comprising single polymeric monofilaments and an array of CD oriented yarns interwoven with the MD oriented yarns, and each adjacent one of the wound turns of the first fabric structure is oriented at an angle to the MD and is bonded to an adjacent turn to provide the continuous unbroken tube-like structure.

14. A seamless press felt, comprising:

an outer base fabric layer, which can be woven or non-woven, having an MD length and CD width including at least a first array of MD oriented yarns and is formed as a continuous unbroken tube structure;

an inner base fabric layer, which can be woven or non-woven, having the MD length and the CD width and including at least a second array of MD oriented yarns and formed as a continuous unbroken tube structure, the inner base fabric layer is located within the outer base fabric layer;

an elastic intermediate yarn assembly including a CD array of mutually parallel and regularly spaced polymeric yarns, each bonded to an elastic carrier material that is extensible by at least 1% of a relaxed length thereof is formed as a continuous unbroken tube structure, the elastic intermediate yarn assembly being located between the inner and outer base fabric layers;

wherein the elastic intermediate yarn assembly has an MD length that is from 1% to 10% less than the MD length prior to assembly and is elastically stretched during assembly between the inner and outer base fabric layers; and at least one batt layer needled through the inner and outer base fabric layers and the elastic intermediate yarn assembly to join the inner and outer base fabric layers and the elastic intermediate yarn assembly together, wherein the outer base fabric layer comprises a plurality of spirally wound turns of a first fabric structure, the first fabric structure including:

a first array of the MD oriented yarns comprising single polymeric monofilaments arranged at a first density, at least two layers of a hot melt adhesive web having a first melting temperature, one of the layers of the hot melt adhesive located on each side of the first planar yarn array, and a layer of a fine fibrous scrim material located over each of the layers of the hot melt adhesive web, wherein the first yarn array, the two layers of the hot melt adhesive web, and the layers of the fine fibrous scrim material located over the two layers of the hot melt adhesive web are heated above the first temperature to form the first fabric structure, and each adjacent one of the wound turns of the first fabric structure is oriented at an angle to the MD and is bonded to an adjacent turn to provide the continuous unbroken tube structure.

15. The fabric according to claim 14, wherein the fine fibrous scrim material is a thermally bonded nonwoven open network of continuous polyamide fibers having a dtex in the range of 1 to 10, and an air permeability of from about 100 cfm (~1560 m3/m2/hr) to about 2,000 cfm (~31,000 m3/m2/hr) or more and which has a second melting temperature that is higher than that of the first melting temperature.

16. The fabric according to claim 14, wherein the yarns of the first MD yarn array are single circular cross-sectional shaped monofilaments having a diameter of 0.2 mm to 0.6 mm arranged at a yarn density of from 15 to 40 yarns/inch (5.9 to 15.7 yarns/cm).

17. A seamless press felt, comprising:

an outer base fabric layer, which can be woven or non-woven, having an MD length and CD width including at least a first array of MD oriented yarns and is formed as a continuous unbroken tube structure;

an inner base fabric layer, which can be woven or non-woven, having the MD length and the CD width and including at least a second array of MD oriented yarns and formed as a continuous unbroken tube structure, the inner base fabric layer is located within the outer base fabric layer;

an elastic intermediate yarn assembly including a CD array of mutually parallel and regularly spaced polymeric yarns, each bonded to an elastic carrier material that is extensible by at least 1% of a relaxed length thereof is formed as a continuous unbroken tube structure, the elastic intermediate yarn assembly being located between the inner and outer base fabric layers;

wherein the elastic intermediate yarn assembly has an MD length that is from 1% to 10% less than the MD length prior to assembly and is elastically stretched during assembly between the inner and outer base fabric layers; and at least one batt layer needled through the inner and outer base fabric layers and the elastic intermediate yarn assembly to join the inner and outer base fabric layers and the elastic intermediate yarn assembly together, wherein the inner base fabric layer comprises a plurality of spirally wound turns of a first fabric structure, the first fabric structure including:

a second array of the MD oriented yarns comprising single polymeric monofilaments arranged at a first density, at least two layers of a hot melt adhesive web having a first melting temperature, one of the layers of the hot melt adhesive located on each side of the second planar yarn array, and a layer of a fine fibrous scrim material located over each of the layers of the hot melt adhesive web, wherein the second yarn array, the two layers of the hot melt adhesive web, and the layers of the fine fibrous scrim material located over the two layers of the hot melt adhesive web are heated above the first temperature to form the first fabric structure, and each adjacent one of the wound turns of the first fabric structure is oriented at an angle to the MD and is bonded to an adjacent turn to provide the continuous unbroken tube structure.

18. The fabric according to claim 17, wherein the fine fibrous scrim material is a thermally bonded nonwoven open network of continuous polyamide fibers having a dtex in the range of 1 to 10, and an air permeability of from about 100 cfm (~1560 m3/m2/hr) to about 2,000 cfm (~31,000 m3/m2/hr) or more and which has a second melting temperature that is higher than that of the first melting temperature.

19. The fabric according to claim 17, wherein the yarns of the second MD yarn array are single circular cross-sectional shaped monofilaments having a diameter of 0.2 mm to 0.6 mm arranged at a yarn density of from 15 to 40 yarns/inch (5.9 to 15.7 yarns/cm).

20. A method of making a press felt, comprising:

providing an outer base fabric layer, which can be woven or non-woven, having an MD length and CD width including at least a first array of MD oriented yarns and is formed as a continuous unbroken tube structure;

providing an inner base fabric layer, which can be woven or non-woven, having the MD length and the CD width and including at least a second array of MD oriented yarns and formed as a continuous unbroken tube structure, the inner base fabric layer is located within the outer base fabric layer;

forming an elastic intermediate yarn assembly comprising a CD array of mutually parallel and regularly spaced polymeric yarns, by arranging the yarns mutually parallel and at a desired spacing, and laminating the component yarns to an adhesive web under heat and pressure in a continuous process, and bonding the laminated component yarns to a nonwoven, elastic carrier material, the elastic carrier material being stretchable allowing the planar yarn assembly to be stretchable in a direction essentially perpendicular to an orientation of the CD array of yarns, and the elastic intermediate yarn assembly is formed as a continuous unbroken tube structure;

locating the elastic intermediate yarn assembly between the inner base fabric layer and the outer base fabric layer;

stretching the elastic intermediate yarn assembly by at least 1% to the MD length; and needling at least one batt layer to the assembled inner base fabric layer, elastic intermediate yarn assembly and outer base fabric layer to form the press felt;

wherein the forming of the elastic intermediate yarn assembly comprises forming a plurality of laminated yarn panels, each including the component yarns that are mutually parallel and at a desired spacing, and assembling a plurality of the yarn panels to form a planar yarn assembly;

forming a connector yarn panel including the component yarns that are mutually parallel and at a desired spacing;

adjusting a MD length of the connector yarn panel to achieve the MD length of the elastic intermediate yarn assembly; and connecting a first edge of the connector yarn panel to a first edge of a first one of the plurality of laminated yarn panels and connecting a second edge of the connector yarn panel to a second edge of a last one of the plurality of laminated yarn panels to form the continuous unbroken tube structure.

21. The method of claim 20, further comprising arranging lateral edges of each of the yarn panels such that a lap join can be formed in which the component yarn spacing is maintained.

* * * * *